US005971533A

United States Patent [19]

Kinoshita et al.

[11] Patent Number: 5,971,533

[45] Date of Patent: Oct. 26, 1999

[54] INK CARTRIDGE AND PRINTER

[75] Inventors: Naohisa Kinoshita; Takemi Yamamoto, both of Nagoya, Japan

[73] Assignee: Brother Kogyo Kabushiki Kaisha, Nagoya, Japan

[21] Appl. No.: 08/998,627

[22] Filed: Dec. 29, 1997

[30] Foreign Application Priority Data

Jan. 7, 1997 [JP] Japan ..... 9-000729

[51] Int. Cl.[6] ..... B41J 2/175

[52] U.S. Cl. ..... 347/86

[58] Field of Search ..... 347/84, 85, 86, 347/87

[56] References Cited

U.S. PATENT DOCUMENTS

| | | | |
|---|---|---|---|
| 4,415,886 | 11/1983 | Kyogoku et al. | 340/618 |
| 4,814,794 | 3/1989 | Sato | 347/28 |
| 5,631,682 | 5/1997 | Takata . | |
| 5,634,730 | 6/1997 | Bobry . | |
| 5,734,401 | 3/1998 | Clark et al. | 347/86 |

FOREIGN PATENT DOCUMENTS

| | | |
|---|---|---|
| 0 553 535 | 8/1993 | European Pat. Off. . |
| 0 560 398 | 9/1993 | European Pat. Off. . |
| 0 604 235 | 6/1994 | European Pat. Off. . |
| 0 615 846 | 9/1994 | European Pat. Off. . |
| 0 720 915 | 7/1996 | European Pat. Off. . |
| 54-151033 | 11/1979 | Japan . |
| 59-192574 | 10/1984 | Japan . |
| 62-161544 | 7/1987 | Japan . |
| 1-141752 | 6/1989 | Japan . |
| 5-116326 | 5/1993 | Japan . |
| 5-138895 | 6/1993 | Japan . |
| 7-323559 | 12/1995 | Japan . |
| 8-295096 | 11/1996 | Japan . |
| 8-298568 | 11/1996 | Japan . |
| 9-85994 | 3/1997 | Japan . |

OTHER PUBLICATIONS

H. T. Findlay, Jet Printer Ink Supply System, IBM Technical Disclosure Bulletin, V. 16, No. 3, pp. 796–798, Aug. 1973.

*Primary Examiner*—John Barlow
*Assistant Examiner*—Michael Nghiem
*Attorney, Agent, or Firm*—Oliff & Berridge, PLC

[57] ABSTRACT

An ink cartridge includes a bag filled with ink and sealed. The bag is housed in a cartridge case. The bag is formed out of a laminate including a ductile film and a rigid film which are laminated together. The case has a hole, through which a hollow needle can protrude from the outside into the case and pierce the bag to take out ink from the bag. The laminate has such a sealing effect that, when it is pierced by the needle, the pierced hole is blocked. The cartridge is suitable for an ink jet printer.

28 Claims, 8 Drawing Sheets

INK CARTRIDGE AND PRINTER

BACKGROUND OF THE INVENTION

1. Field of the Invention

The present invention relates to an ink cartridge for storing liquid ink for use with an ink jet head or another print head, and supplying the ink to the head. The invention also relates to a printer with which such a cartridge can be used.

2. Description of Related Art

Ink cartridges for use with ink jet printers etc. are classified into a group of cartridges each fixed to a print head, and another group of cartridges each removably fitted to a print head. The removable cartridges each include an ink tank made of resin. The tank houses a foamed or porous member impregnated with ink. The tank has an ink supply port through which ink can be discharged to the head. The tank also has an air vent hole through which air is taken in from the outside when ink is consumed.

For example, U.S. Pat. No. 5,631,682 discloses an ink supply device including a case which houses a foamed or porous member. This member is impregnated with ink and wrapped in a film in bag form. The case has an ink supply port projecting into it and connected to the print head of a printer. When the impregnated and wrapped member is inserted into the case, the projecting port presses the member, piercing the film so that ink is supplied through the port to the head. It is possible to exchange ink by replacing only the impregnated and wrapped member, without throwing away the case, and without the user's hands being smeared with ink.

Recently, a very small portable ink jet printer has been invented as disclosed in Japanese Patent Laid-Open Publications No. 8-295096, No. 8-298568, No. 9-85994 and U.S. Pat. No. 5,634,730. For such a small printer, a cartridge of the foregoing type is not suitable which needs relatively large volume to house in a case a foamed member impregnated with ink. In order that a printer may be portable, it is necessary to completely prevent ink from leaking out of the connection between the print head of the printer and the ink cartridge mounted on the printer, whichever positioned the printer is.

SUMMARY OF THE INVENTION

In view of the foregoing problems, it is an object of the invention to provide an ink cartridge of simple structure which is easy to handle and high in productivity, mechanical strength and barrierability, but without air mixed with the liquid ink being supplied from the cartridge, and without ink leaking out of the cartridge when a sheet of paper is printed.

It is another object to provide a printer for use with such a cartridge.

In accordance with a first aspect of the invention, an ink cartridge is provided, which includes a bag filled with ink and sealed. The bag is formed out of a laminate including films different in elongation. The bag is housed in a cartridge case. The case has a hole, through which a hollow needle can protrude from the outside into the case. The protruding needle can pierce the bag to take out ink from the bag.

This cartridge can have very simple structure which, as stated above, includes a cartridge case and a bag housed in it. As also stated, the case has a hole through which a hollow needle can protrude. The needle may have an ink passage or bore formed in it. Ink can be taken out of the bag simply by the needle protruding through the case hole into the case and piercing the bag. Therefore, the cartridge can be produced very easily, and the production costs can be low.

The laminate films differ in ductility. More ductile films are higher in elongation or breaking elongation. Less ductile films are generally higher in tensile strength, and strong against external injuries as well. Therefore, the laminate is strong against external injuries and has such a sealing effect that, when it is pierced by the needle, the pierced hole is blocked. In particular, if the cartridge is used with an ink jet printer, it is possible to, on the basis of the sealing effect, maintain good meniscuses at the nozzles of the ink jet head for the following reason.

When the needle has pierced the bag, and ink has been sucked (consumed) from the bag through the passage in the needle, the bag contracts in volume. Because the elasticity or resiliency of the bag tends to restore the bag to the original shape, negative pressure develops in the bag and forces the ink in the nozzles of the ink jet head back toward the cartridge. The negative pressure maintains the ink meniscuses formed at the front ends of the nozzles. As a result, it is not necessary for the cartridge to house a foamed member in it as is the case with conventional ink cartridges.

Because the bag is housed in the cartridge, the bag is protected effectively against pressure, trouble, etc. from the outside.

In order to improve the bag sealing effect, it is preferable that the laminate include a rigid film and a ductile film. The ductile film may be made of polyethylene, polypropylene or other polyolefine resin which is high in strength and good as a gas barrier.

At least one of the films may be a synthetic resin film which is not oriented. Because the film which is not oriented has no crystal orientation, cracks are not liable to develop in the film when the needle pierces it. The laminate may further include an adhesive layer between adjacent two of the films. When the needle pierces the laminate, the adhesive layer bring the needle and the laminate into closer contact with each other, making the ink sealing effect more secure. Even if cracks develop in the surfaces of the laminate, the adhesive layer prevent the cracks from propagating.

The rigid film may be a nylon film which is not oriented. In order to prevent ink leakage, the ductile film may be a linear chain low-density polyethylene (LLDPE) film. These films may be bonded to each other with a urethane adhesive layer.

The laminate may include a film having compressive stress. When the needle pierces the bag (laminate), the stress causes this film to block the pierced hole. This brings the film into close contact with the needle, preventing ink leakage securely. It is also possible to prevent the cracks developed in the laminate by external injuries from progressing.

It is possible to form a laminate which includes a film having compressive stress by bonding films having different coefficients of thermal expansion together at high temperature and cooling the bonded films. If the laminate of the bag includes an outer film having a higher coefficient of thermal expansion, compressive stress can remain on the outside of the bag during cooling.

It is possible to form the bag by folding the laminate in two and heat-sealing the edge of the folded laminate to shape the laminate into a bag. The bag may be housed in the cartridge case in such a manner that the sealed edge of the laminate may not be exposed through the hole of the case. In this instance, the needle can easily pierce the bag without causing ink leakage.

In accordance with a second aspect, a printer is provided, which includes a print head and an ink feeder for feeding the head with ink. The feeder includes a hollow needle which has an ink passage formed therein. One end of the passage communicates with the head. An ink cartridge can be mounted on and removed from the printer. The cartridge includes a bag filled with ink and sealed. The bag is formed out of a laminate including films different in elongation. The bag is housed in a cartridge case. The case has a hole through which the needle can protrude from the outside into the case. The protruding needle can pierce the bag to send ink out of the bag into the head.

This printer has structure suitable for the ink cartridge of the invention, which includes a cartridge case and a bag housed in it. Ink can be taken out of the bag simply by the needle protruding through the case hole into the case and piercing the bag. Therefore, it is very easy to produce the printer, and it is possible to reduce the cost of producing the printer as well as the cartridge. As stated above, the laminate of the bag includes films differing in ductility. Therefore, the laminate is strong against external injuries, and the ink is prevented securely from leaking out even when the needle has pierced the bag. In particular, if the printer is an ink jet printer, it is possible, for the foregoing reason, to maintain good meniscuses at the nozzles of the ink jet head on the basis of the sealing effect of the bag. By combining the printer and the cartridge both of the invention, it is possible to make the printer very small. The printer may further include a holder for housing the cartridge. The holder may have a guide for guiding the hole of the cartridge case to the needle of the feeder. The cartridge may include a part for engaging with the guide.

The needle of the printer may have a hole formed at its end adjacent to the other end of its ink passage. The hole communicates with the passage.

Otherwise, the needle may have a hole formed through its peripheral wall near this end of the needle. The hole communicates with the passage. In this case, in interlocking relation with the removal of the ink cartridge from the needle which has pierced it, a cover may be caused to cover the needle hole in order to prevent the ink from leaking through the hole. The cover may be a boot, a ring or the like made of rubber or the like which covers the whole needle or the hole.

BRIEF DESCRIPTION OF THE DRAWINGS

Preferred embodiments of the invention are shown in the accompanying drawings, in which.

DETAILED DESCRIPTION OF PREFERRED EMBODIMENTS

Figure 1A:
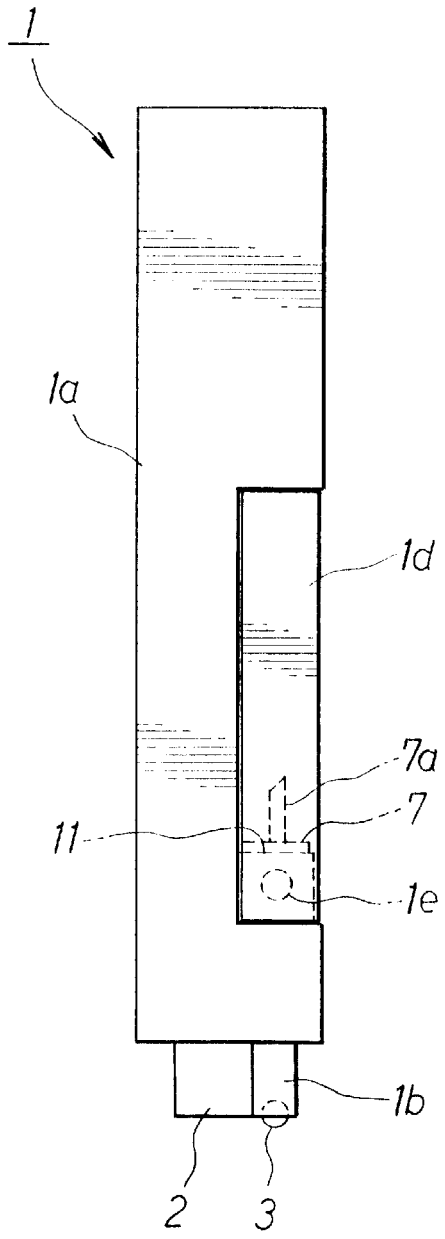
FIGS. 1A and 1B are schematic side views of an ink jet printer according to one of the embodiments, showing the printer with the housing lid closed and open, respectively.
Figure 1B:
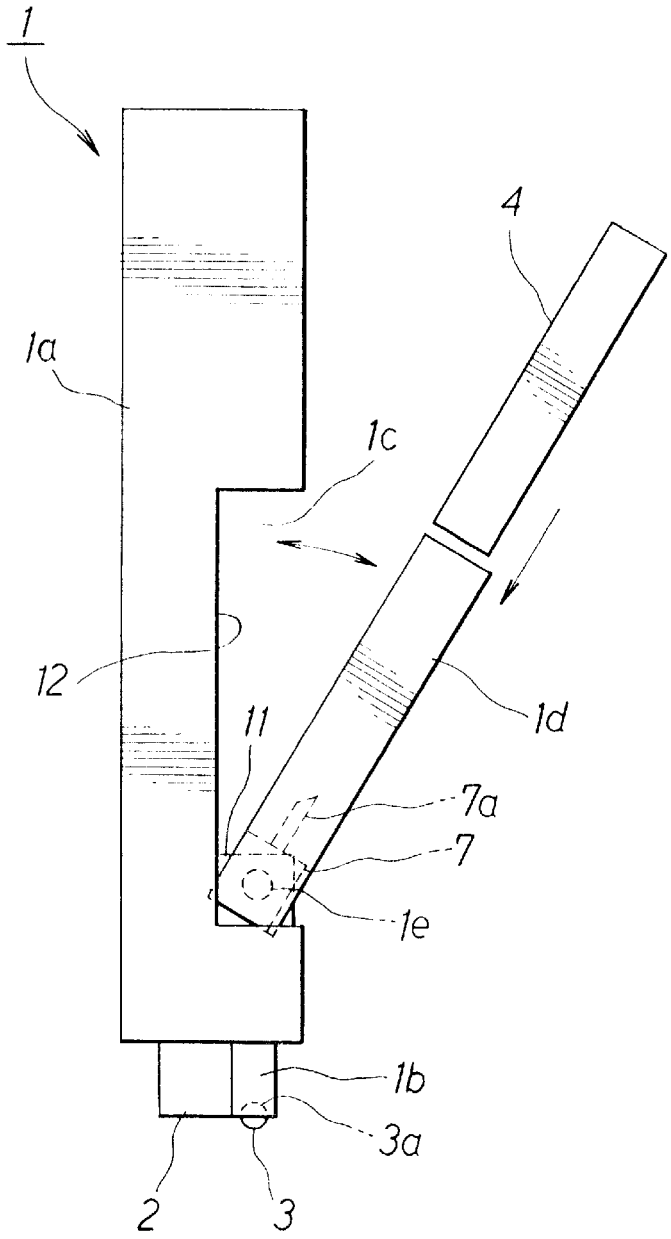

With reference to FIGS. 1A and 1B, a printer 1 is an ink jet type recorder, which can print a printing medium by ejecting ink onto the medium while the printer is moved manually over the medium. The printer 1 includes a housing 1*a*. Formed on the bottom of the housing 1*a* are a print head (recording means) 2 for ejecting ink and a frame 1*b*. The frame 1*b* supports a roller 3 for spacing the printer 1 at a constant distance from the printing medium while the printer 1 is moved over the medium.

Figure 2:
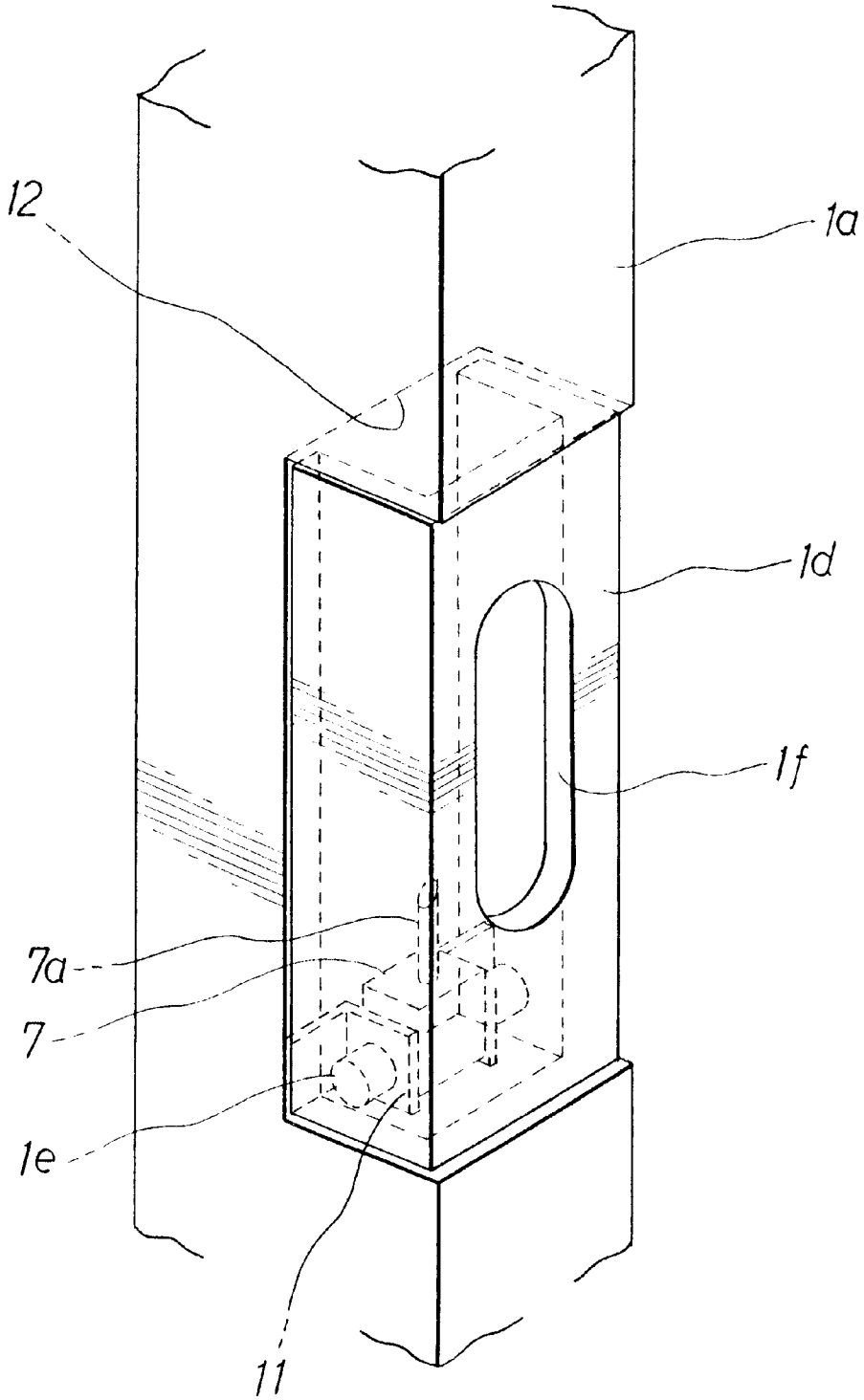
FIG. 2 is an enlarged perspective view of part of the printer.
Figure 3:
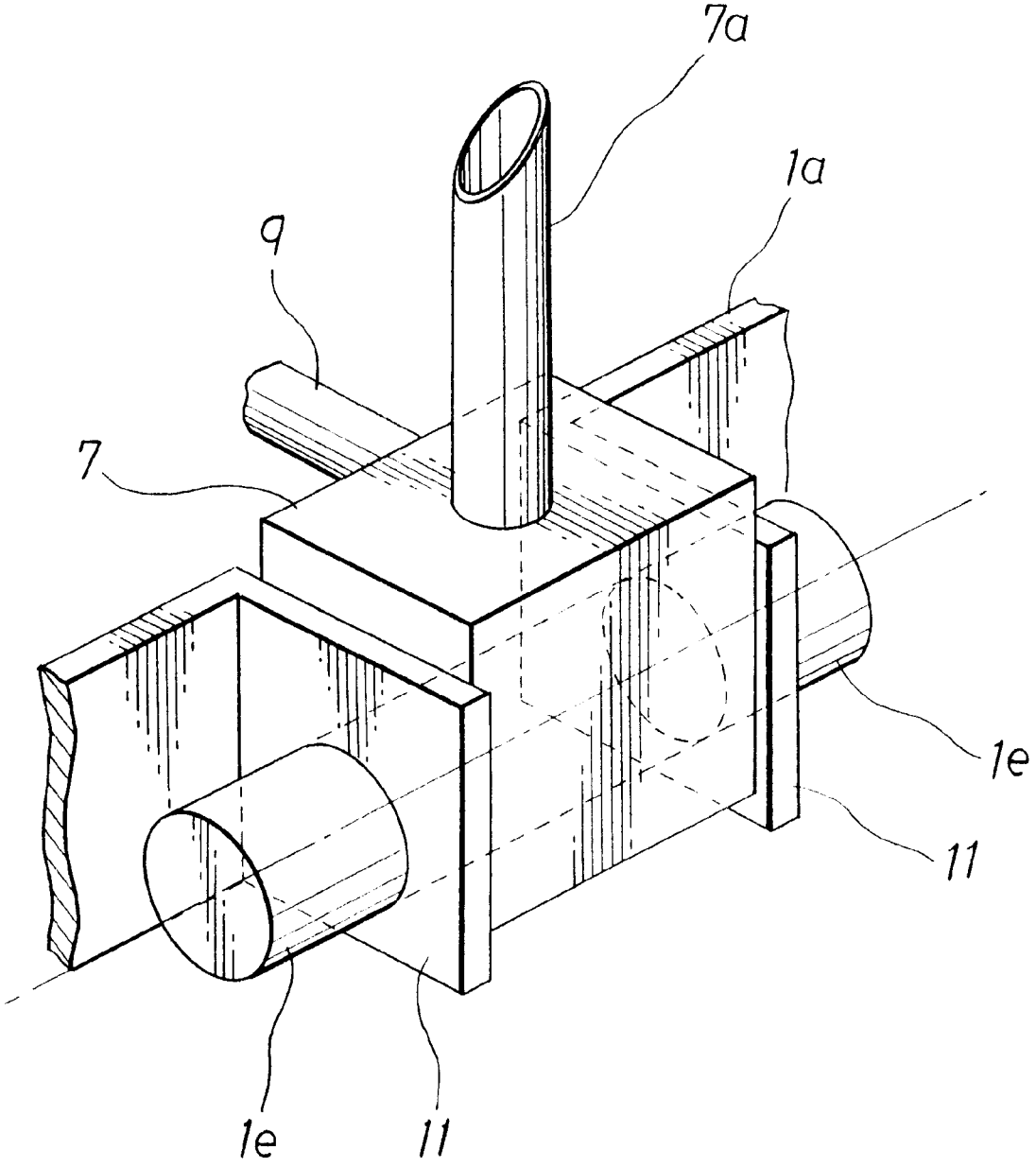
FIG. 3 is a further enlarged perspective view of part of the printer.

The rotation of the roller 3 is transmitted through a pulley, a belt, etc. (not shown) to an encoder (not shown), which is fitted in the printer 1. The number of revolutions and the rotational speed of the roller 3 are measured with the encoder. On the basis of the measured values, the amount of movement of the printer 1 is detected with a controller (not shown), which is fitted in the printer 1, for controlling the drive of the printer. On the basis of the amount of movement, printing control is made for the printer 1. Ink is stored in an ink cartridge 4. The housing 1*a* has a cavity or recess 1*c*, in which the cartridge 4 can be positioned. The housing 1*a* is fitted with a housing lid or cover 1*d*, which is so shaped that the cartridge 4 can be fitted in it. As shown in FIG. 2, the lid 1*d* includes a pair of opposite side walls and a wall connecting their adjacent edges together. As best shown in FIG. 3, the housing 1*a* includes a pair of support plates 11, on which a pin or shaft 1*e* is supported rotatably. As shown in FIG. 2, the bottom of the lid 1*d* is fixed to both ends of the pin 1*e* outside the support plates 11 so that the lid can pivot around the pin 1*e* into and out of the cavity 1*c*.

Positioned in a lower portion of the lid 1*d* is a cartridge holder 7, which is fixed to the pin 1*e* in order to turn with the lid around the pin. A hollow needle 7*a* extends through and is fixed to an upper portion of the holder 7. Both ends of the needle 7*a* are open. An upper portion of the needle 7*a* enters the cartridge 4 when the cartridge is placed on the top of the holder 7. The housing cavity 1*c* is so shaped that the lid 1*d*, cartridge 4, holder 7 and needle 7*a* can be positioned in it when the lid is closed.

Figure 4A:
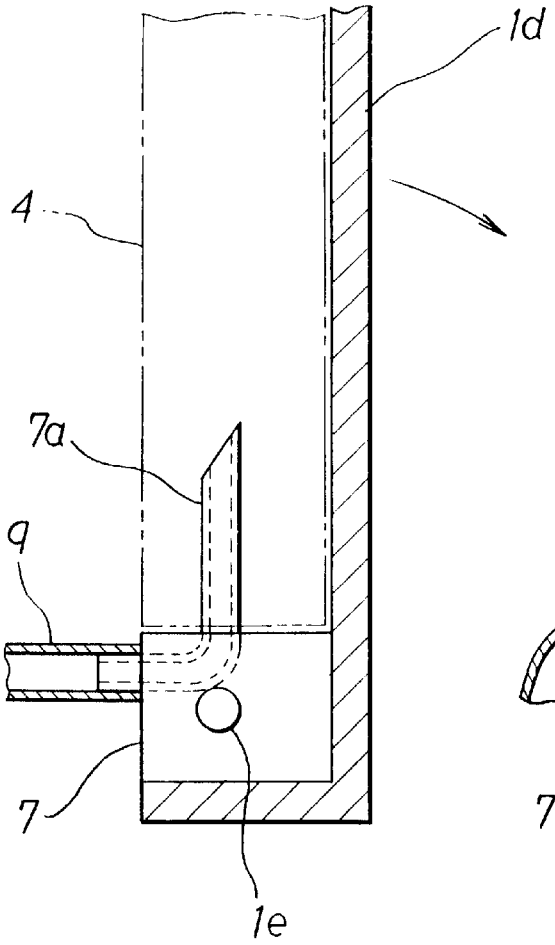
FIGS. 4A and 4B are enlarged cross sections of part of the printer, showing the printer with the lid closed and open, respectively.
Figure 4B:
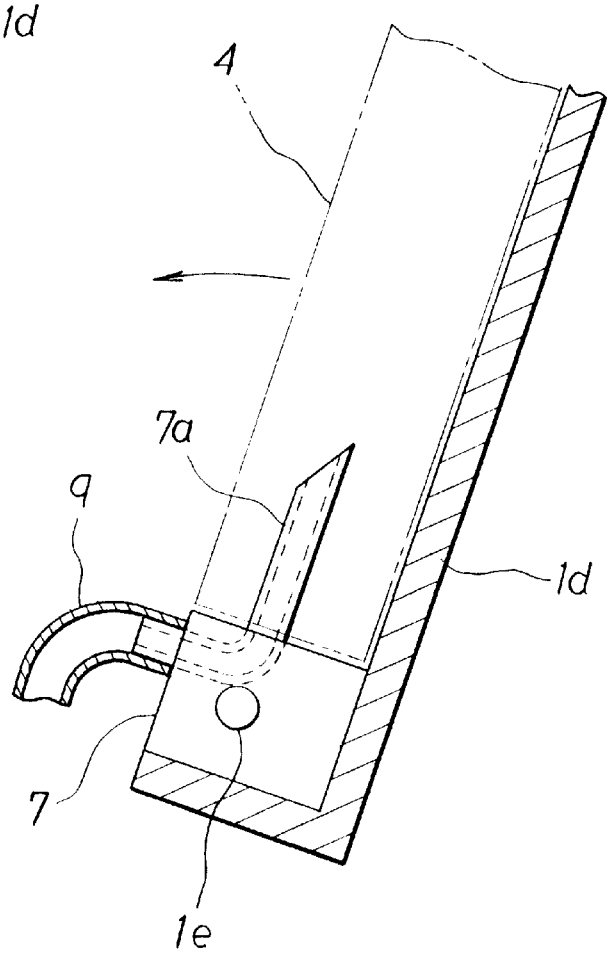

As shown in FIGS. 4A and 4B, the lower end of the needle 7*a* is connected to a flexible supply tube 9, which can bend as the holder 7 turns. The tube 9 is connected to the print head 2 so that ink can be supplied from the cartridge 4 to the head. Thus, the lid 1*d* and holder 7 can turn together relatively to the housing 1*a*.

Figure 5:
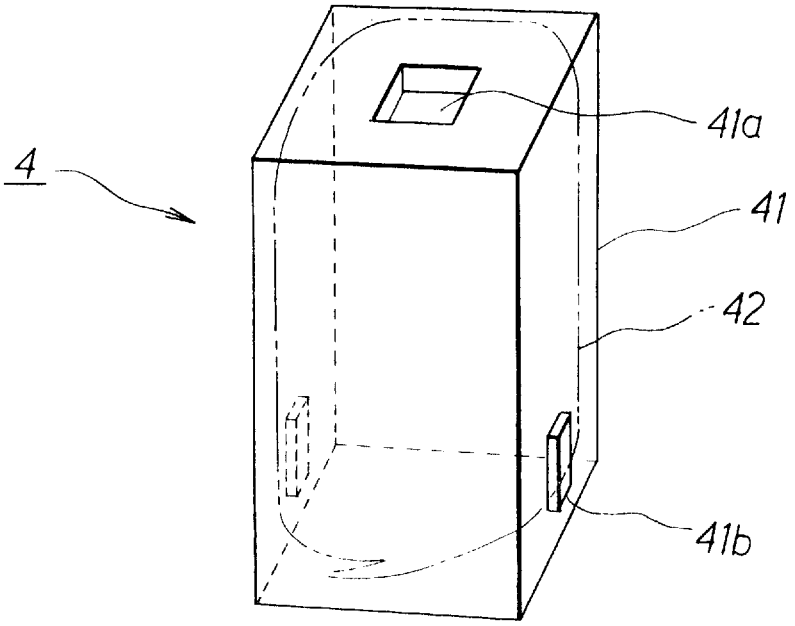
FIG. 5 is an enlarged perspective view of the ink cartridge of the printer.

With reference to FIG. 5, the cartridge 4 includes a cartridge case 41, which is a resinous hard case, and an ink bag 42 housed in the case and containing ink. The needle 7*a* shown in FIGS. 4A and 4B is a tubular member, and at least its portion which can pierce into the bag 42 has a constant outer diameter and a smooth outer surface. It is preferable that the outer surface be coated with silicon. The upper portion of the needle 7*a* extends longitudinally of the cartridge 4 positioned in the lid 1*d*. Precisely, this portion extends longitudinally of the bag 42 put in the cartridge 4 in the lid 1*d*.

Figure 8:
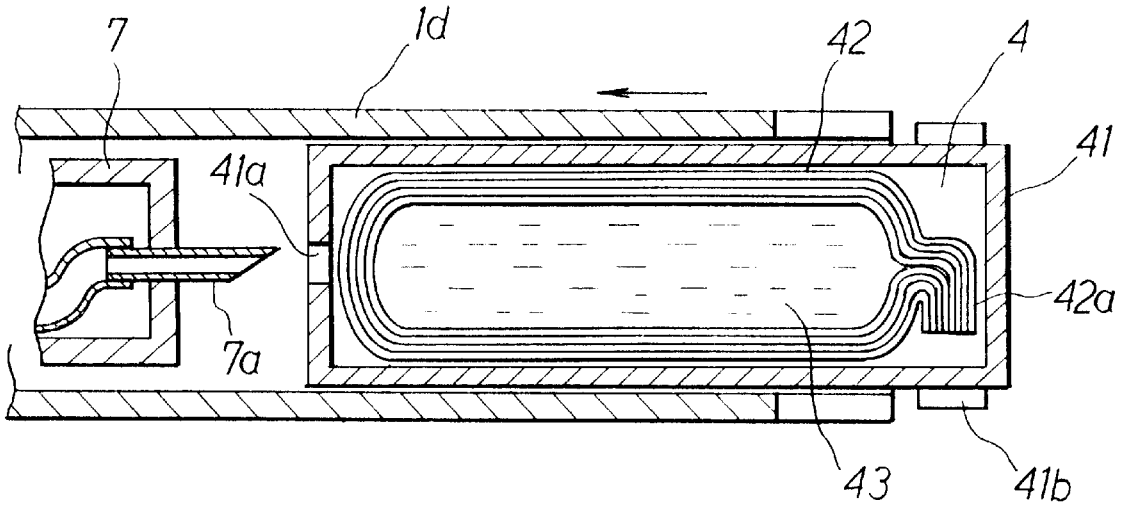
FIG. 8 is a cross section of part of an ink jet printer according to another embodiment of the invention, showing the ink cartridge being fitted into the housing lid.
Figure 9:
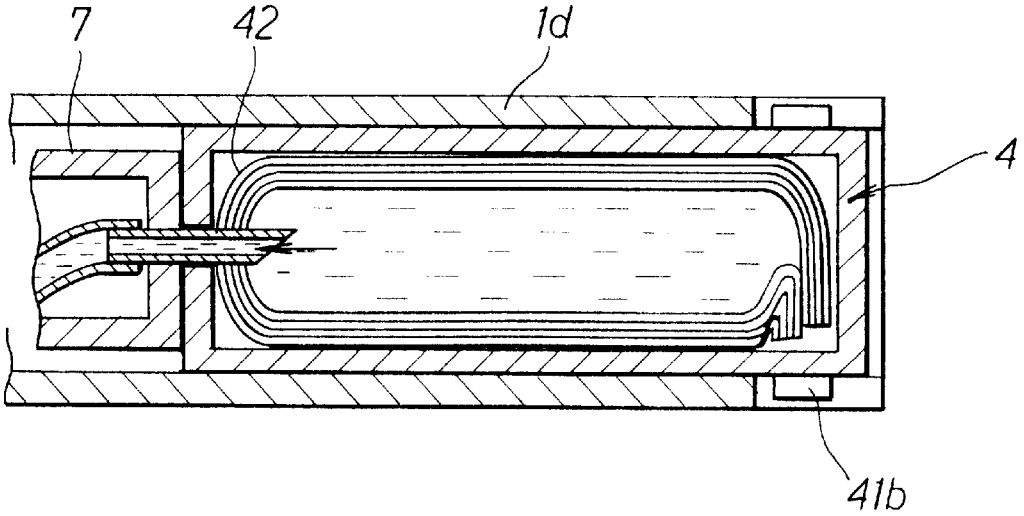
FIG. 9 is a cross section of part of the printer shown in FIG. 8, showing the cartridge having been put in the lid.

As shown in FIG. 5, the cartridge case 41 is a hollow box having a window 41*a* formed through its one end wall, through which the upper portion of the needle 7*a* can enter the case. The case 41 includes a pair of outer protrusions 41*b* formed on opposite side walls thereof. The protrusions 41*b* are near to the other end wall of the case 41. As shown in FIGS. 8 and 9, the lid 1*d* has a pair of top recesses 50 and 52 formed in opposite side walls thereof for engagement with the cartridge protrusions 41*b*. The protrusions 41*b* prevent the cartridge 4 from being fitted in the lid 1*d* with the window 41*a* up (FIG. 5).

The cartridge case 4 may not necessarily be very liquid-tight. The window 41*a* is larger sufficiently than the diameter of the needle 7*a*, and functions as an air vent hole, also.

Figure 7:
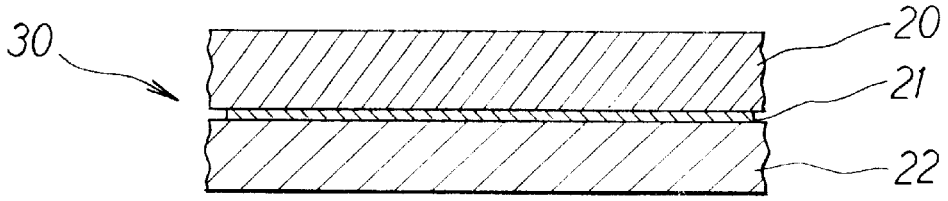
FIG. 7 is a further enlarged cross section of part of the bag.

The ink bag 42 is made of synthetic resin film. More specifically, as shown in FIG. 7, the bag 42 is made of laminated film 30, which includes an inner ductile film 20 as a sealing layer and an outer rigid film 22. The films 20 and 22 are bonded to each other with an adhesive layer 21 interposed between them. The inner layer 20 is a synthetic resin film which has a high elongation percentage. The outer layer 22 is a synthetic resin film which has a low elongation percentage, and which is high in mechanical strength, such as tensile strength and rigidity.

As defined by JIS K6900, the elongation percentage of a synthetic resin represents the deformation of the resin with respect to a tensile force, and is the ratio of the length of the elongated material to the original or initial length of the material. The elongation percentage until fracture of a material is referred to as the breaking elongation (extension), or simply as the elongation or the elongation percentage, the ductility, or the like of the material. The elongation percentages of various synthetic resin materials are shown on pages 136 and 137 of the first edition of Kimimasa Ito "PLASTIC DATA HANDBOOK" (Kogyo Chosakai), for example.

Figure 6:
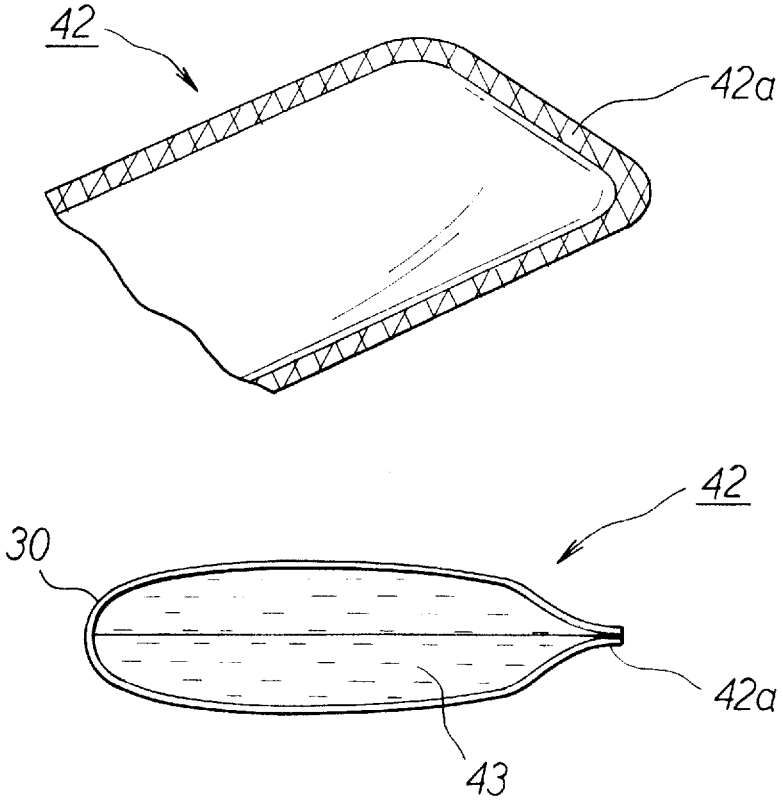
FIG. 6 is a partial schematic side view and another schematic side view of the ink bag housed in the cartridge.

The whole ink bag 42 is formed out of the laminated film 30. As shown in FIG. 6, the film 30 is folded in two, and the edge 42*a* of the folded film is heat-sealed to form the bag 42. The ink bag 42 containing the ink therein may be manufactured by the following process. For example, the laminated film 30 is folded in two, and a side end and a lower end of the folded film are temporarily sealed to form a bag with an opening at the upper end. After discharging the ink into the bag through the opening of the upper end, these ends are heat-sealed.

FIGS. 8 and 9 show another ink bag 42 which can be housed in the cartridge case 41. In order to improve its durability and sealing effect, this bag 42 is made of laminated film including two ductile film layers (20) and rigid film layers (22) which are laminated alternately.

As a result of the heat sealing, the resin of the sealed edge 42*a* of the ink bag 42 is modified or converted, and/or the lamination structure of this edge is broken, so that the sealing effect of the edge is lowered. If the needle 7*a* pierced the edge 42*a*, ink might leak out. Therefore, the bag 42 is housed in the cartridge case 41 in such a manner that the edge 42*a* may not be exposed through the case window 41*a* so that the needle 7*a* may not pierce this edge.

The detail of the laminated film 30 and a method of forming this film are described below.

The material of the ductile film 20 has a higher coefficient of thermal expansion than the rigid film 22. The films 20 and 22 are bonded to each other with the adhesive layer 21 at high temperature. The bonded films are cooled to room temperature. When the films are cooled, the ductile film 20 shrinks more than the rigid film 22, applying compressive residual stress to the rigid film.

The ductile film 20 may be a film not oriented of low density polyethylene, polypropylene or other polyolefine, polyvinyl chloride, or the like. Each of these materials has an elongation percentage of 300 or more %. In general, these materials are so good barriers that, if the ductile film 20 is one of them, little gas such as oxygen and steam permeates through the film 20, and mixes with the ink in the bag 42.

The rigid film 22 may be a film not oriented of polyamide nylon or other nylon, polyethylene terephthalate (PET), or polyimide. Because the films 20 and 22 are not oriented and have no crystal orientation, cracks are not liable to develop in them. Because the compressive residual stress is applied to the rigid film 22 when the laminated film 30 is formed, cracks are not liable to develop in the rigid film 22. When the needle 7*a* pierces the ductile film 20, the elasticity of this film develops residual stress at the pierced film part in the directions in which the needle is tightened. Even if very small cracks develop in the rigid film 22, the adhesive layer 21 prevents them from propagating to the ductile film 20.

Figure 10:
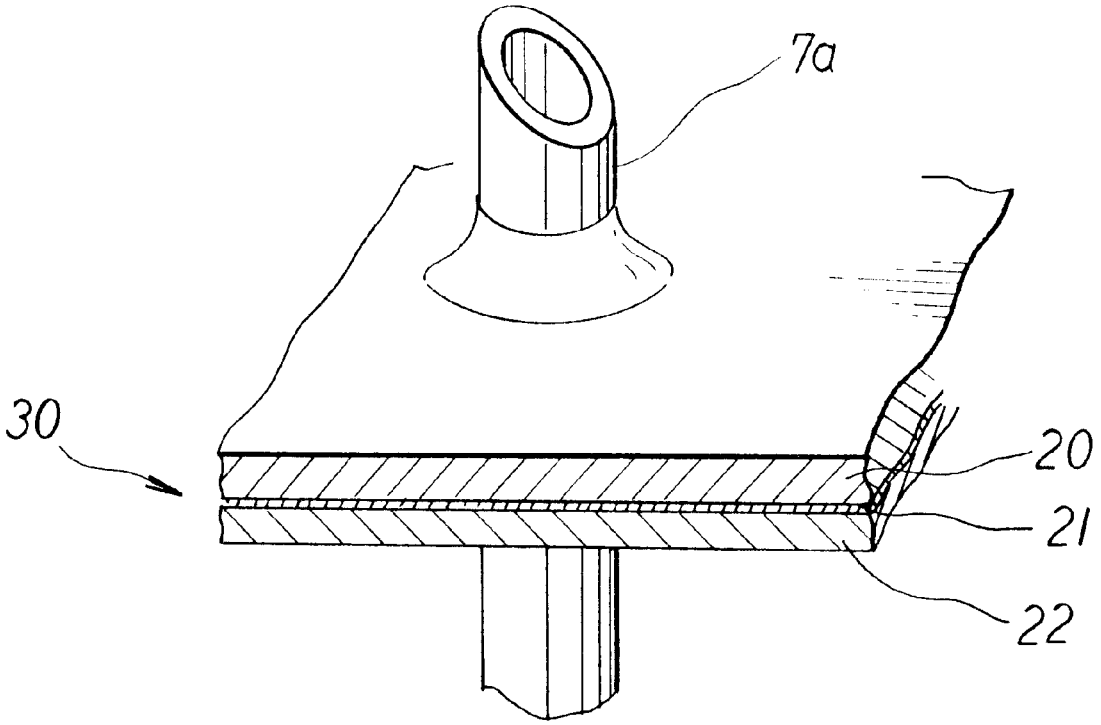
FIG. 10 is an enlarged perspective view, partially in section, of part of the printer of the first embodiment, showing the needle having pierced the bag.

Consequently, when the needle 7*a* pierces the laminated film 30 of the bag 42, as shown in FIG. 10, no cracks develop in the pierced part of the ductile film 20. This keeps the bag 42 closed, preventing the ink 43 from leaking out of it, and outside air from entering it. Therefore, the bag 42 functions as a highly air-tight and liquid-tight bag.

If the adhesive layer 21 is a known elastic adhesive, it is more effective in preventing the cracks from propagating. Besides, when the needle 7*a* pierces the layer 21, the elastic adhesive is more effective in keeping the outer surface of the needle and the cut surface of this layer in close contact with each other. Therefore, this adhesive is more effective in preventing the ink from leaking out and air from mixing with the ink.

With reference to FIGS. 1, 4, 8 and 9, the ink cartridge 4 is fitted in the lid 1*d* in the following way.

With the lid 1*d* open, as shown in FIG. 1B, the cartridge 4 is put into the lid from above in the indicated direction. As the lid 1*d* opens, the needle 7*a* fixed to the cartridge holder 7 turns outward around the pin 1*e*. The top of the needle 7*a* faces always toward the top of the lid 1*d*, that is to say, toward the bottom of the cartridge 4 being put into the lid. Consequently, when the cartridge 4 is fitted into the lid 1*d*, the needle 7*a* protrudes through the window 41*a* into the cartridge, piercing the ink bag 42. As a result, the cartridge 4 and needle 7*a* are connected smoothly together. As stated above, the needle 7*a* is a tubular member, and at least its portion which can pierce the ink bag 42 has a constant outer diameter and a smooth outer surface. The needle 7*a* is characterized in that, when the ink cartridge 4 is fitted into the lid 1*d*, the needle 7*a* pierces the bag 42 perpendicularly to the cartridge bottom surface. More precisely, the needle 7*a* pierces the bag 42 perpendicularly to the laminated film 30. Therefore, when the needle 7*a* pierces the film 30, the pierced hole is not larger than necessary, and the needle and film do not interfere with each other, so that no cracks develop in the film. While the cartridge 4 is fitted, the film 30 and the needle 7*a*, which has pierced it, are in close contact properly and uniformly with each other, without gaps formed between them. Consequently, while the cartridge 4 is fitted, the needle 7*a* does not easily come out of it, and no ink leaks around the needle through the pierced hole.

As stated above, the upper portion of the needle 7*a* extends longitudinally, not along the width, of the ink cartridge 4 positioned in the lid 1*d*. Precisely, this portion extends longitudinally of the ink bag 42 put in the cartridge 4 in the lid 1*d*. Therefore, even when part of the ink in the bag 42 has been consumed and the bag has deflated, the laminated film 30 does not cover and block the top of the needle 7*a*. Consequently, all of the ink can be supplied.

Figure 11A:
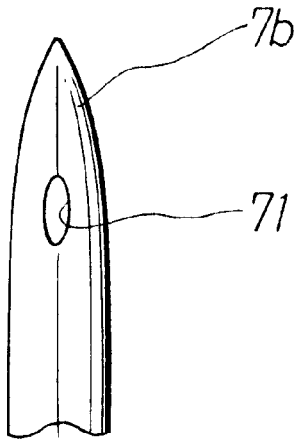
FIGS. 11A and 11B are a side view and a longitudinal cross section, respectively, of part of the hollow needle of an ink jet printer according to still another embodiment of the invention.
Figure 11B:
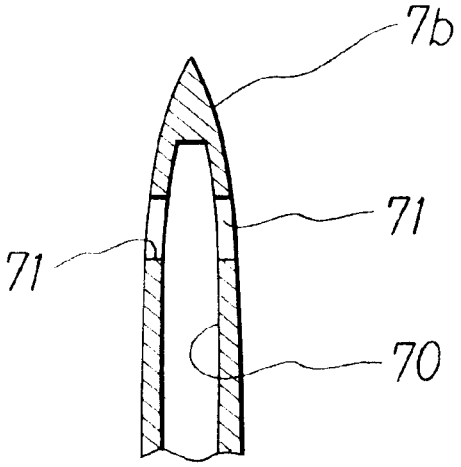

FIGS. 11A and 11B show a modified hollow needle 7*b* for use in place of the needle 7*a*. The needle 7*b* has an ink passage or bore 70 formed in it, and its top is tapered and closed. The needle 7*b* has a pair of holes 71 formed through its circumferential wall near its top, which open into the passage 70. In interlocking relation with the removal of the ink cartridge from the needle 7*b* which has pierced it, a cover (not shown) may be caused to cover the needle holes 71 in order to prevent the ink from leaking through them. The cover may be a boot, a ring or the like, which may be made of rubber, for covering the whole needle 7*b* or the holes 71. When the needle 7*b* pierces the ink bag, the needle is not liable to damage the bag more than necessary, and foreign bodies, broken pieces of the bag, etc. are prevented from entering the needle.

The present invention is not limited to the foregoing embodiments, but various modifications can be made without departing from the spirit and scope of the invention. For example, the whole ink bag 42 is formed out of the laminated film 30, but the bag structure is not limited to this. Instead, an ink bag may be made of rigid film (22), and only its portion for exposure through the window 41*a* of the cartridge case 41 may be of laminated structure, where the inner surface of the rigid film is lined with a ductile film (20) stuck to it. However, if the whole bag 42 is formed out of the laminated film 30, the bag as a whole can be more rigid and closer sealed. This makes it possible to provide a reliable ink bag which is strong against external injuries, and from which no ink leaks. In this case, during the production of the ink cartridge 4, it is not necessary to position the bag 42 relatively to the window 41*a* of the cartridge case 41 when the bag is housed in the case.

The foregoing embodiments have been described in connection with a manually movable (scanning) printer as an example, but the invention is not necessarily limited to the structure of this printer. The invention can also be applied to various recorders each for use with a replaceable ink cartridge. Of course, the invention can be applied to automatically movable printers as well.

What is claimed is:

1. An ink cartridge for connection with an ink feeder having a hollow needle, the ink cartridge comprising:

a bag filled with ink and sealed, the bag being directly pierced by the hollow needle to allow the ink to be supplied out of the bag, wherein the bag forms a liquid-tight seal around the hollow needle after the hollow needle pierces the bag.

2. The cartridge defined in claim 1 wherein the bag is formed by folding a laminate in two to form a folded laminate and heat-sealing an edge of the folded laminate to shape the laminate into the bag, the bag being housed in a cartridge case in such a manner that a sealed edge is not exposed through the hole of the case.

3. The cartridge defined in claim 1, wherein the bag is formed out of a laminate of films.

4. The cartridge defined in claim 3 wherein the laminate includes a rigid film and a ductile film.

5. The cartridge defined in claim 4 wherein the ductile film is made of polyolefine resin.

6. The cartridge defined in claim 3 wherein at least one of the films is a synthetic resin film which has not been stretched.

7. The cartridge defined in claim 3 wherein the laminate further includes an adhesive layer between an adjacent two of the films.

8. The cartridge defined in claim 3 wherein one of the films has a compressive residual stress remained thereon.

9. The cartridge defined in claim 8 wherein the films have different coefficients of thermal expansion, the films being bonded together at high temperature and cooled thereafter.

10. The cartridge defined in claim 3 wherein the laminate includes a nylon film and a linear chain low-density polyethylene film which are laminated to each other with an adhesive layer, the nylon film being not stretched.

11. The cartridge defined in claim 3, wherein the laminate includes films having different elongation.

12. The cartridge defined in claim 1, further comprising a cartridge case in which the bag is housed, the case having a hole through which the hollow needle enters the case from an outside of the case.

13. A printer comprising:

a print head;

an ink feeder for feeding the print head with ink, the feeder including a hollow needle which has an ink passage formed therein, the passage communicating at one end thereof with the print head; and an ink cartridge mountable on and removable from the printer, the cartridge including a bag filled with ink and sealed, the bag being directly pierced by the hollow needle to allow the ink to be supplied out of the bag, wherein the bag forms a liquid-tight seal around the hollow needle after the hollow needle pierces the bag.

14. The printer defined in claim 13 wherein the needle has a hole formed at an end thereof which is adjacent to another end of the ink passage thereof, the hole communicating with the ink passage.

15. The printer defined in claim 13 wherein the needle has a hole formed through a peripheral wall thereof near an end thereof which is adjacent to another end of the ink passage thereof, the hole communicating with the ink passage.

16. The printer defined in claim 13 wherein the bag is formed by folding a laminate in two to form a folded laminate and heat-sealing an edge of the folded laminate to shape the laminate into the bag, the bag being housed in a cartridge case in such a manner that a sealed edge is not exposed through the hole of the case.

17. The printer defined in claim 13, wherein the bag is formed out of a laminate of films.

18. The printer defined in claim 17 wherein the laminate includes a rigid film and a ductile film.

19. The printer defined in claim 18 wherein the ductile film is made of polyolefine resin.

20. The printer defined in claim 17 wherein at least one of the films is a synthetic resin film which has not been stretched.

21. The printer defined in claim 17 wherein the laminate further includes an adhesive layer between an adjacent two of the films.

22. The printer defined in claim 17 wherein one of the films has a compressive residual stress remained thereon.

23. The printer defined in claim 22 wherein the films have different coefficients of thermal expansion, the films being bonded together at high temperature and cooled thereafter.

24. The printer defined in claim 17 wherein the laminate includes a nylon film and a linear chain low-density polyethylene film which are laminated to each other with an adhesive layer, the nylon film being not stretched.

25. The printer defined in claim 17, wherein the laminate includes films having different elongation.

26. The printer defined in claim 13, wherein the ink cartridge further comprises a cartridge case in which the bag is housed, the case having a hole through which the hollow needle enters the case from an outside of the case.

27. The printer defined in claim 26, and further comprising a holder for housing the cartridge, the holder having a guide for guiding a hole of the cartridge case to the needle of the feeder.

28. The printer defined in claim 27 wherein the cartridge includes a part for engaging with the guide of the holder.

* * * * *